US006415725B1

(12) United States Patent
Yoshikazu

(10) Patent No.: US 6,415,725 B1
(45) Date of Patent: Jul. 9, 2002

(54) SEWING MACHINE WITH A WORK PRESSING BAR POSITIONING DEVICE

(75) Inventor: Ebata Yoshikazu, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/837,438

(22) Filed: Apr. 17, 2001

(30) Foreign Application Priority Data

Apr. 28, 2000 (JP) ..... 2000-130842

(51) Int. Cl.[7] ..... D05B 29/02
(52) U.S. Cl. ..... 112/237
(58) Field of Search ..... 112/237, 238, 112/239, 221, 284, 220

(56) References Cited

U.S. PATENT DOCUMENTS 4,056,071 A * 11/1977 Adams ..... 112/237
5,590,614 A * 1/1997 Murata et al. ..... 112/237
5,596,941 A * 1/1997 Landen ..... 112/239

FOREIGN PATENT DOCUMENTS

JP 3117790 * 11/1986 ..... 112/239

* cited by examiner

*Primary Examiner*—Ismael Izaguirre
(74) *Attorney, Agent, or Firm*—Nields & Lemack

(57) ABSTRACT

A sewing machine with a work pressing bar positioning device is disclosed, the sewing machine substantially comprising a work pressing bar holding mechanism including an upper holder movable axially of a work pressing bar and a lower holder fixedly connected to the work pressing bar, spring means including a compression spring having a force for normally pressing down the upper holder axially of the work pressing bar, a height changing mechanism including a guide member which is operated to move between a first position laterally close to the work pressing bar and a second position laterally away from the work pressing bar and a transmission mechanism operated in response to operation of the guide member to operate the work pressing bar holding mechanism, the transmission mechanism including upper and lower links which are operatively connected to each other and to the guide member while the upper link has one end operatively connected to the upper holder and the lower link has one end operatively connected to the lower holder, such that the lower link may be operated in one direction away from the upper link against the action of a tension spring to transmit force of the compression spring to the work pressing bar by way of the upper holder, the upper and lower links and the lower holder when the guide member is in the first position and the work pressing bar is in a lower operative position.

3 Claims, 13 Drawing Sheets

SEWING MACHINE WITH A WORK PRESSING BAR POSITIONING DEVICE

BACKGROUND OF THE INVENTION AND RELATED ART STATEMENT

1. Field of the Invention

The present invention relates to a sewing machine and more particularly relates to a device for positioning a work pressing bar between an upper inoperative position and a lower operative position easily and smoothly with a reduced force.

2. Prior Art

Generally the work pressing bar has a work pressing foot removably attached to a lower end thereof and is positioned between an upper inoperative position where the work pressing foot is vertically spaced from a work to be stitched on a needle plate and may be changed and a lower operative position where the work pressing foot is in contact with the work to be stitched on a needle plate. The work pressing bar is normally pressed down with a pressure applied thereto by a compression spring such that the work pressing foot may press the work against the needle plate with a predetermined force while the work pressing bar is at the lower operative position. It is, therefore, required that the work pressing bar is moved to the upper inoperative position from the lower operative position against the pressing force of the compression spring by operation of a lever or the like.

The compression spring to be used is, however, of a considerably strong force because the work pressing foot is required to press a work against the needle plate with a required force, the work including various kinds of thick cloths including leathers. The machine operator is, therefore, required to exert a considerably strong force in order to move the work pressing bar to the upper inoperative position from the lower operative position by operation of a lever which is generally provided in connection with the work pressing bar.

OBJECTS OF THE INVENTION

The invention has been provided to eliminate the defects and disadvantages of the prior art. It is, therefore, a primary object of the invention to provide a device for positioning a work pressing bar, which may be easily and smoothly operated with a reduced force.

It is another object of the invention to provide a work pressing bar positioning device which is simple and compact in mechanism and reliable in operation.

It is another object of the invention to provide a work pressing bar positioning device which is operated to indirectly transmit an operating force to the work pressing bar so that the latter may be moved between an upper inoperative position and a lower operative position with a reduced force.

It is another object of the invention to provide a work pressing bar positioning device including an upper holder which is movable axially of the work pressing bar and is normally subjected to a downward spring action of a compression spring and a lower holder fixedly connected to the work pressing bar and a transmission mechanism which is operated between the upper and lower holders to transmit the downward spring action of the compression spring to the work pressing bar when the work pressing bar is in the lower operative position.

It is another object of the invention to provide a tension spring exerting a spring action for normally urging the lower holder towards the upper holder so as to move the work pressing bar to the upper inoperative position when the transmission mechanism is operated to lose the action for transmitting the downward spring action of the compression spring to the work pressing bar.

It is still another object of the invention to provide a member which is manually or automatically operated to operate the transmission mechanism.

SUMMARY OF THE INVENTION

Namely the invention substantially comprises a work pressing bar holding mechanism including an upper holder movable axially of a work pressing bar and a lower holder fixedly connected to the work pressing bar, spring means including a compression spring having a force for normally pressing down the upper holder axially of the work pressing bar, a height changing mechanism including a guide member which is operated to move between a first position laterally close to the work pressing bar and a second position laterally away from the work pressing bar and a transmission mechanism operated in response to operation of the guide member to operate the work pressing bar holding mechanism, the transmission mechanism including upper and lower links which are operatively connected to each other and to the guide member while the upper link has one end operatively connected to the upper holder and the lower link has one end operatively connected to the lower holder, such that the lower link may be operated in one direction away from the upper link against the action of a tension spring to transmit force of the compression spring to the work pressing bar by way of the upper holder, the upper and lower links and the lower holder when the guide member is in the first position and the work pressing bar is in a lower operative position. The work pressing bar is moved to an upper inoperative position by the action of the tension spring which moves the lower holder until the same comes to contact the upper holder when the guide member is in the second position.

DETAILED DESCRIPTION OF THE PREFERRED EMBODIMENTS

The invention will now be described in reference to the preferred embodiments of the invention as shown in the attached drawings.

Figure 1:
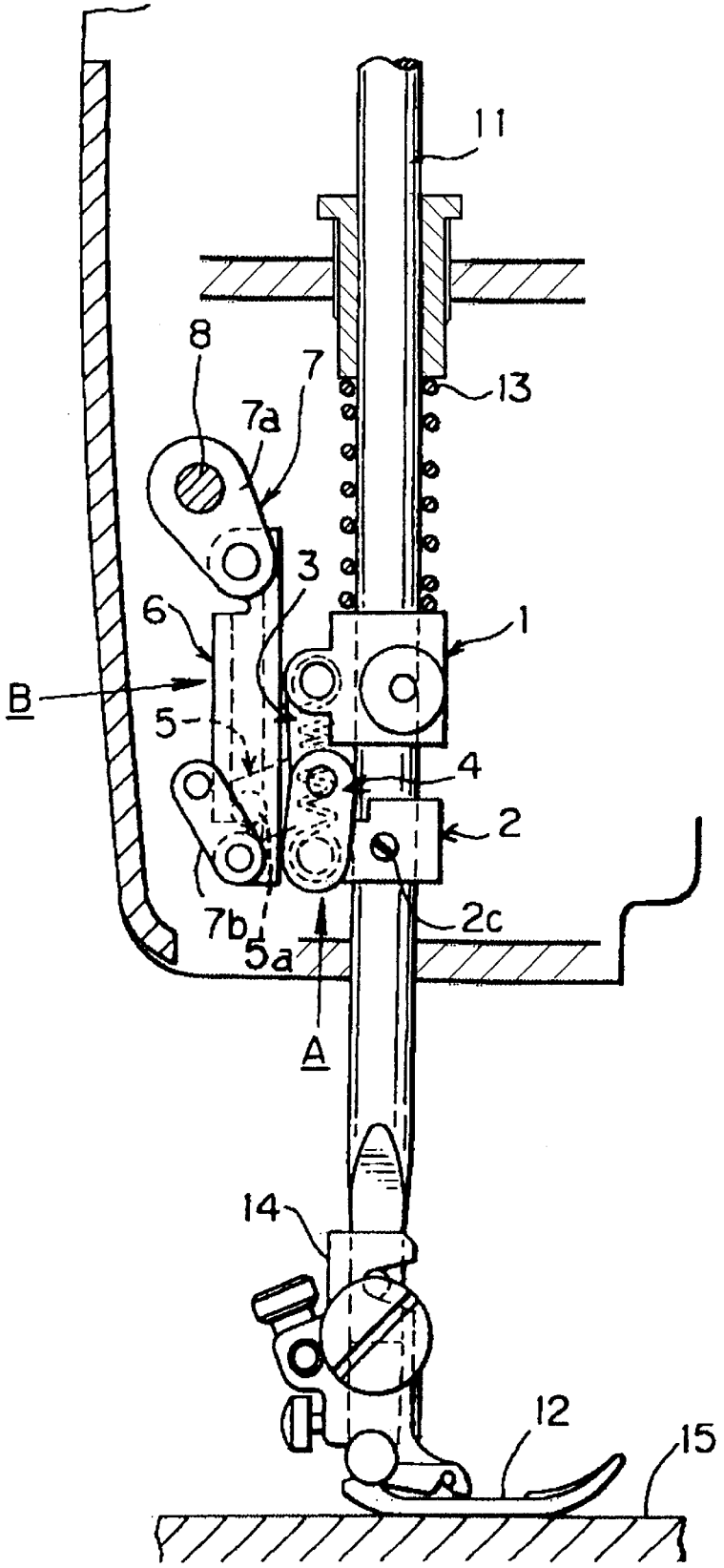
FIG. 1 is a side elevational view of a work pressing bar positioning device of the invention with a work pressing bar having an ordinary stitching work pressing foot attached to the lower end of a work pressing bar and being in a lower operative position.
Figure 2A:
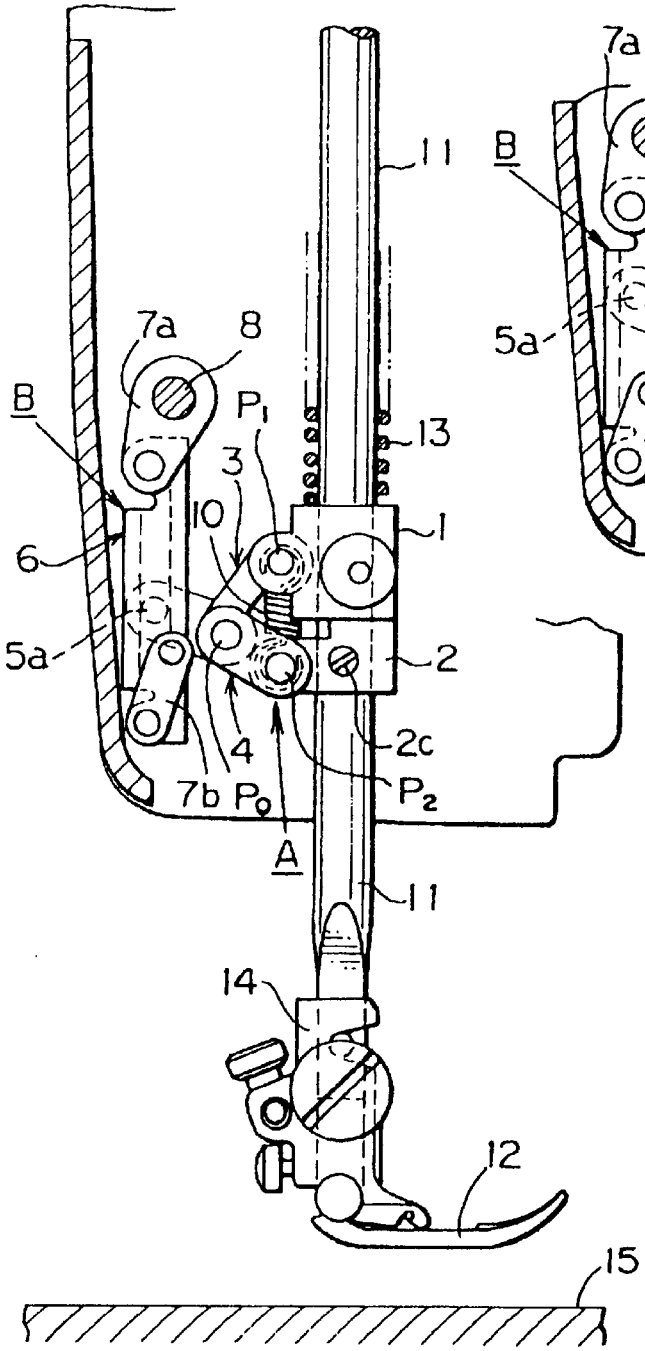
FIG. 2A is a side elevational view of the work pressing bar positioning device wherein the work pressing bar is in an upper inoperative position.
Figure 2B:
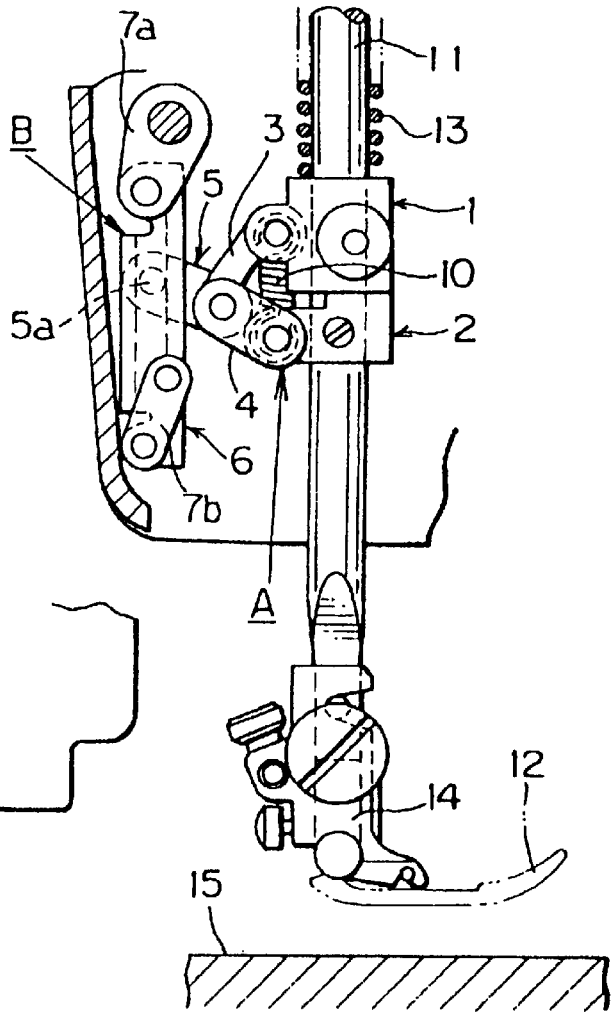
FIG. 2B is a side elevational view of the work pressing bar positioning device wherein the work pressing bar is removed from the work pressing bar shown in FIG. 2A.

In reference to FIGS. 1, 2A and 2B, the invention relates to a sewing machine with a work pressing bar positioning device provided in connection with a work pressing bar 11 of a sewing machine having a work pressing foot 12 removably attached to the lower end thereof, and operated to move the work pressing bar 11 between a lower operative position where the work pressing foot 12 is in contact with a needle plate 15 and an upper inoperative position where the work pressing foot 12 is away from a needle plate 15. The positioning device comprises a holder mechanism including an upper holder 1 and a lower holder 2, a height changing mechanism B and a transmission mechanism A.

Figure 3A:
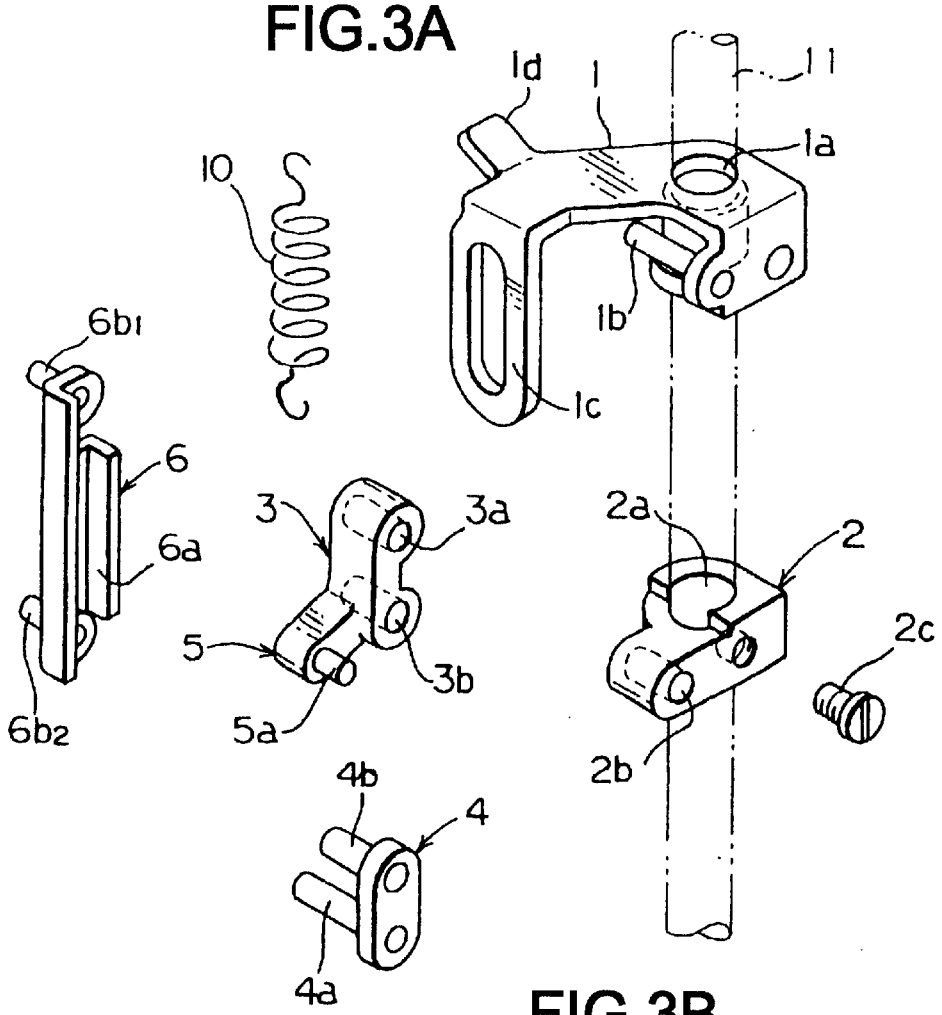
FIG. 3A is an exploded view of the essential parts of the work pressing bar positioning device.
Figure 3B:
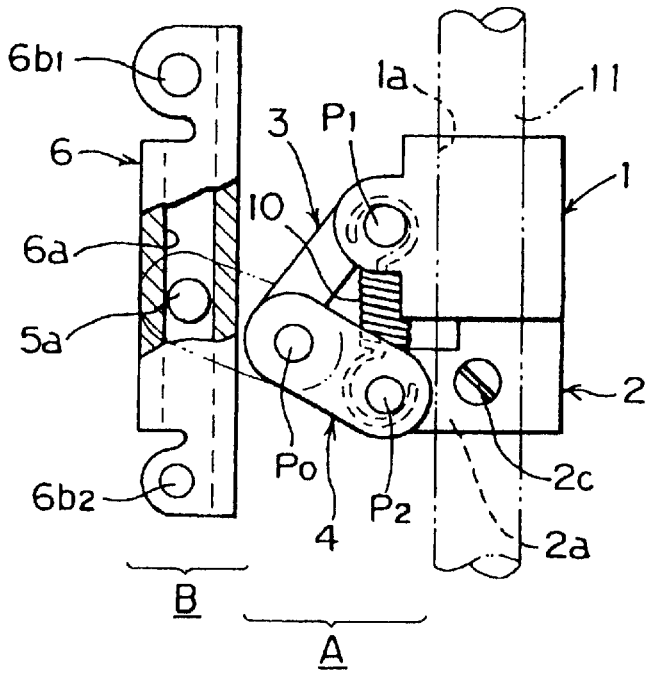
FIG. 3B is a side elevational view of the essential parts of the work pressing bar positioning device shown as being assembled.

As particularly shown in FIGS. 3A and 3B, the transmission mechanism A includes a link mechanism including an upper link 3 and a lower link 4 which are operatively connected to the holder mechanism and to the height changing mechanism B to move the upper and lower holders 1 and 2 towards and away from each other.

The upper holder 1 is mounted to the work pressing bar 11 by way of a through-hole 1*a* thereof and is movable axially of the work pressing bar 11. The upper holder 1 has a pin 1*b* laterally extending for pivotally engaging the upper link 3 of the link mechanism A as will be described in detail hereinlater. The upper holder 1 is partly bent down to provide a position regulating part 1*c* having an elongated opening which is to receive a pin or the like (not shown) to be inserted therethrough.

The lower holder 2 is mounted to the work pressing bar 11 by way of a vertical through-hole 2*a* thereof and is fixedly connected to the work pressing bar 11 by a fastening screw 2*c*. The lower holder 2 has a laterally extending through-hole 2*b* for receiving a pin to be inserted therethrough and is pivotally connected to the lower link 4 of the link mechanism A as will be described in detail hereinlater.

FIG. 1 shows that the work pressing bar 11 is set in a lower operative position wherein the work pressing foot 12 is in contact with a needle plate 15 for stitching operation. On the other hand, FIGS. 2A and 2B show that the work pressing bar 11 is set in an upper inoperative position wherein the work pressing foot 12 is spaced from the needle plate 15 while the stitching operation is not carried out or the work pressing foot 12 is changed.

The upper link 3 has a hole 3*a* laterally extending at the upper part thereof for pivotally receiving the pin 1*b* of the upper holder 1, thus defining a pivot point $P_1$. The upper link 3 has another hole 3*b* laterally extending at the lower part thereof for pivotally receiving a laterally extending pin 4*b* of the lower link 4, thus defining a pivot point $P_0$. The lower link 4 has another laterally extending pin 4*a* inserted into the hole 2*b* of the lower holder 2 and defining a pivot point $P_2$.

The upper link 3 has a lever part 5 formed as is offset from the lower part thereof. The lever part 5 is laterally projected from the upper link 3 at the angle, for example, of about 75° and has a laterally extending pin 5*a* which is operatively connected to the height changing member 6 as will be described in detail hereinlater.

The height changing mechanism B includes a substantially U-shaped and vertically extended height changing member 6 having a guide 6*a* which is in engagement with the pin 5*a* of the lever part 5 of the upper link 3 and has a pair of laterally extending pins $6b_1$ and $6b_2$ secured to the opposite ends thereof respectively and further includes a link mechanism 7 provided in connection with the pins $6b_1$ and $6b_2$. The link mechanism 7 includes an upper swingable link 7*a* and a lower swingable link 7*b*. The upper swingable link 7*a* has an upper part fixedly connected to one end of an upper rotary operating shaft 8 which is rotatably mounted to a machine frame and has a lower part pivotally connected to the upper pin $6b_1$ of the height changing member 6 while the lower swingable link 7*b* has an upper part fixedly connected to a lower rotary operating shaft 8 which is rotatably mounted a machine frame and has a lower part pivotally connected to the upper pin $6b_2$ of the height changing member 6.

Figure 4A:
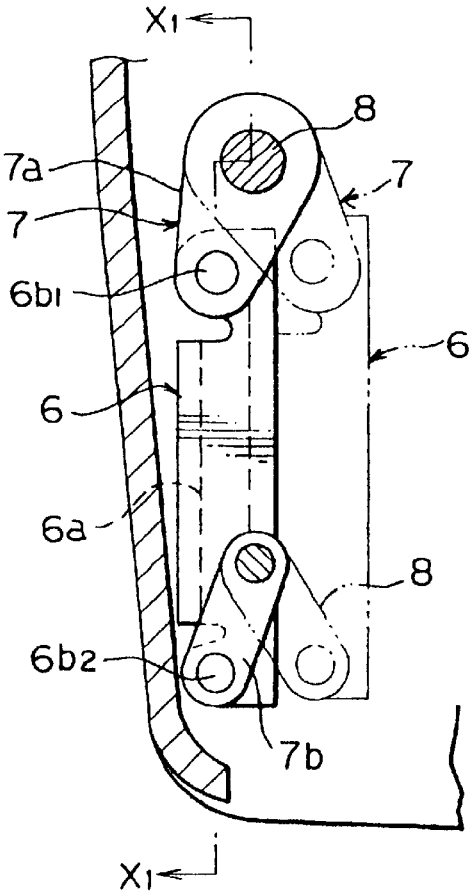
FIG. 4A is a side elevational view of a height changing mechanism of the work pressing bar positioning device.
Figure 4B:
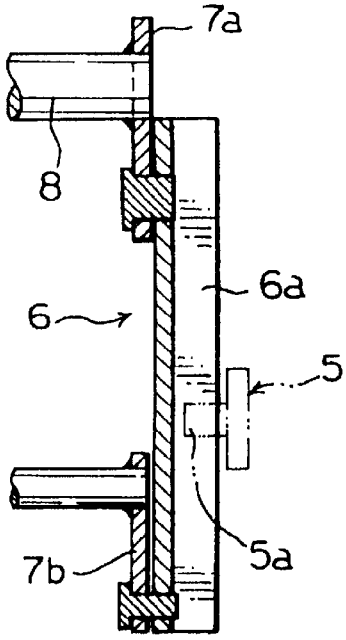
FIG. 4B is a side elevational view of the height changing mechanism taken along the line $X_1$—$X_1$ of FIG. 4A.

One of the rotary operating shafts 8, that is, the upper rotary operating shaft 8 is operatively connected to a drive source (not shown) so as to be reciprocatingly rotated, thereby to swingingly move the upper and lower swingable links 7*a* and 7*b*. Thus the height changing member 6 may be laterally moved with respect to the work pressing bar 11 between a first position wherein the member 6 is located far away from the work pressing bar 11 as illustrated by a solid line in FIG. 4A and a second position wherein the member 6 is located close to the work pressing bar 11 as illustrated by an imaginary line in FIG. 4A.

The upper and lower links 3 and 4 are, therefore, rotatingly moved around the pivot point $P_0$ in one direction where the upper and lower links 3 and 4 come towards each other and in the opposite direction where the upper and lower links 3 and 4 move away from each other. In the meantime, the pin 5*a* is vertically moved as guided by the guide 6*a* as the height changing member 6 is laterally moved, thereby to move the upper and lower holders 1 and 2 towards and away from each other, so that the work pressing bar 11 may be moved between the upper and lower set positions.

Figure 4C:
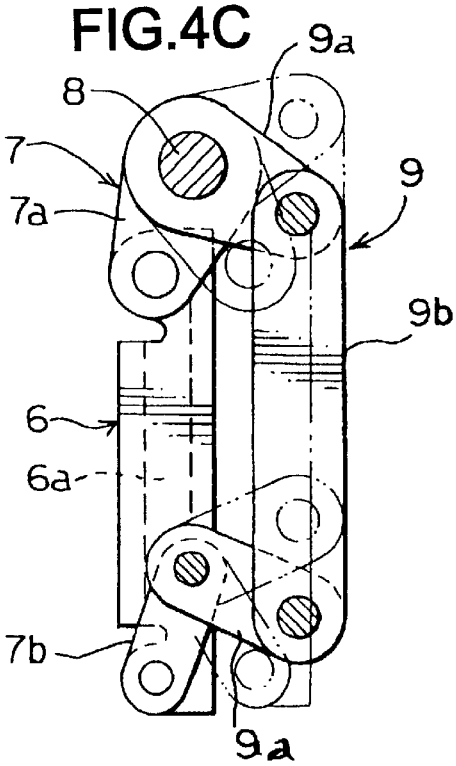
FIG. 4C is a side elevational view of the height changing mechanism shown in connection with an auxiliary link mechanism.

As particularly shown in FIG. 4C, an auxiliary link mechanism 9 may be provided in connection with the link mechanism 7. The link mechanism 9 includes two short links 9*a*, 9*a* and one elongated link 9*b* which are provided to form a 4-joint link mechanism together with the upper and lower swingable links 7*a*, 7*b* such that the upper and lower links 7*a*, 7*b* may be operated in synchronism with each other, thereby to correctly move the height changing member 6 in the lateral direction.

As shown in FIGS. 3B and 5A through 6B, a tension spring 10 is provided between the pivot point $P_1$ and the pivot point $P_2$. Precisely the tension spring 10 has one end anchored to the pin 1*b* of the upper holder 1 and the opposite end anchored to the pin 4*a* of the link 4, the pin 4*a* being inserted into the through-hole 2*b* of the lower holder 2. Thus the tension spring 10 normally gives a force to move the lower holder 2 towards the upper holder 1, that is, a force to move the work pressing bar 11 to the upper inoperative position.

Figure 5A:
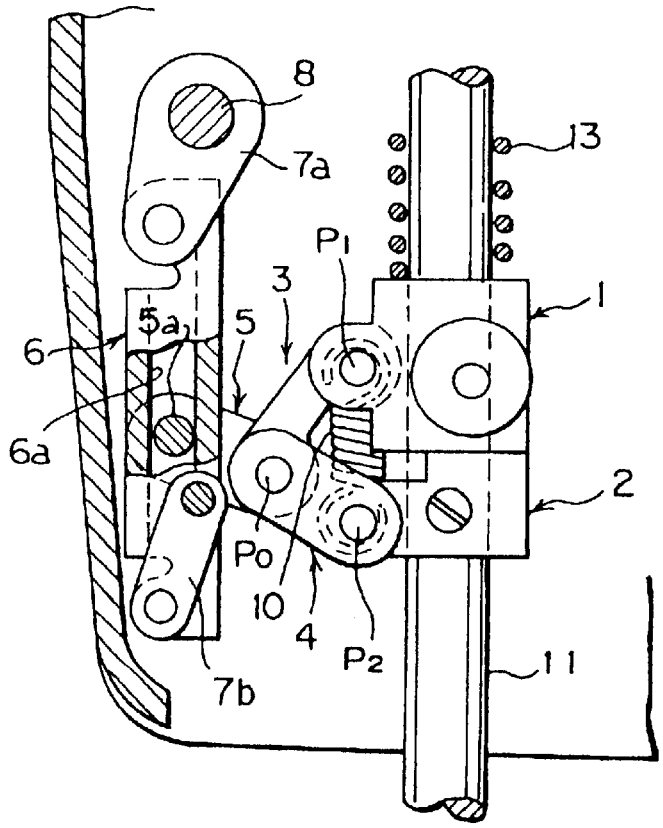
FIG. 5A is an enlarged side elevational view of the work pressing bar positioning device which is operated to move upper and lower work pressing bar holders close to each other.

Namely when the height changing member 6 is operated to move to the first position as shown in FIG. 5A wherein the height changing member 6 is far away from the work pressing bar 11, the lower link 4 is rotated around the pivot point $P_0$ in the direction towards the upper link 3 by the force of the tension spring 10 until the lower holder 2 comes to contact the upper holder 1. In the meantime, the pin 5*a* of the lever part 5 of the upper link 3 is vertically moved as guided by the guide 6*a*.

Figure 5B:
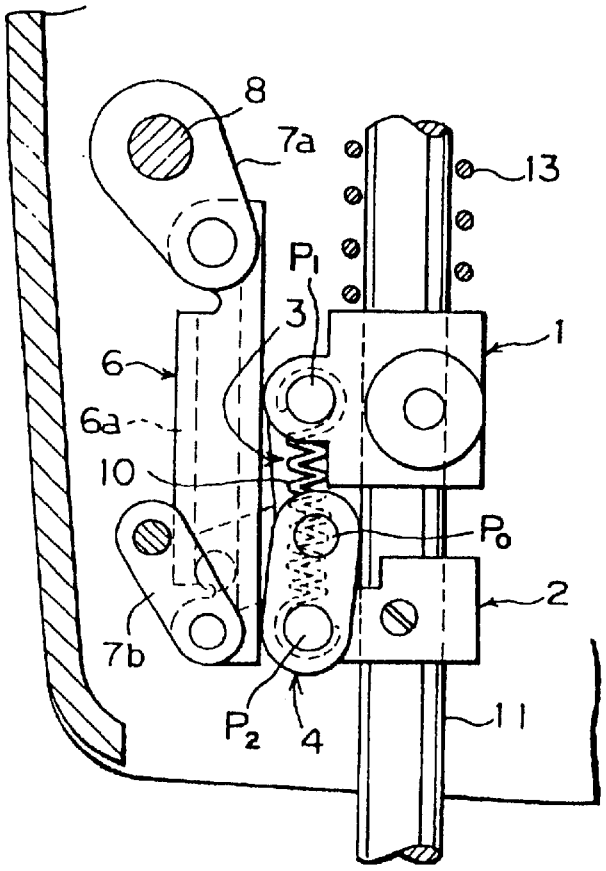
FIG. 5B is an enlarged side elevational view of the work pressing bar positioning device which is operated to move upper and lower work pressing bar holders far from each other.
Figure 6A:
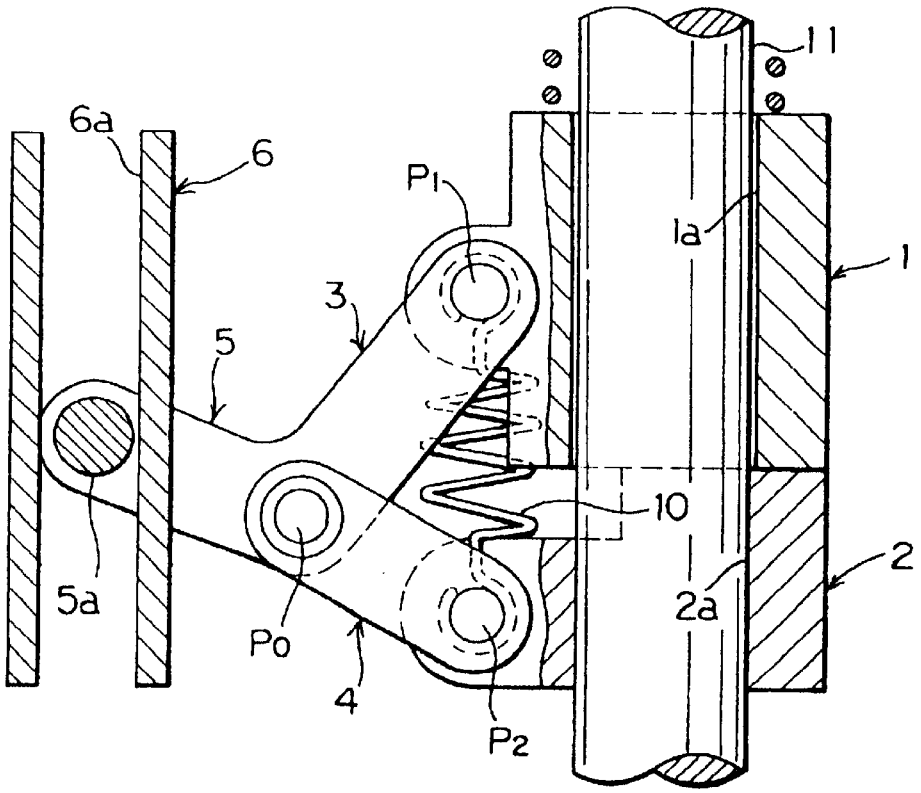
FIG. 6A is a further enlarged side elevational view of the essential part of the work pressing bar positioning device of FIG. 5A shown as partly sectioned.
Figure 6B:
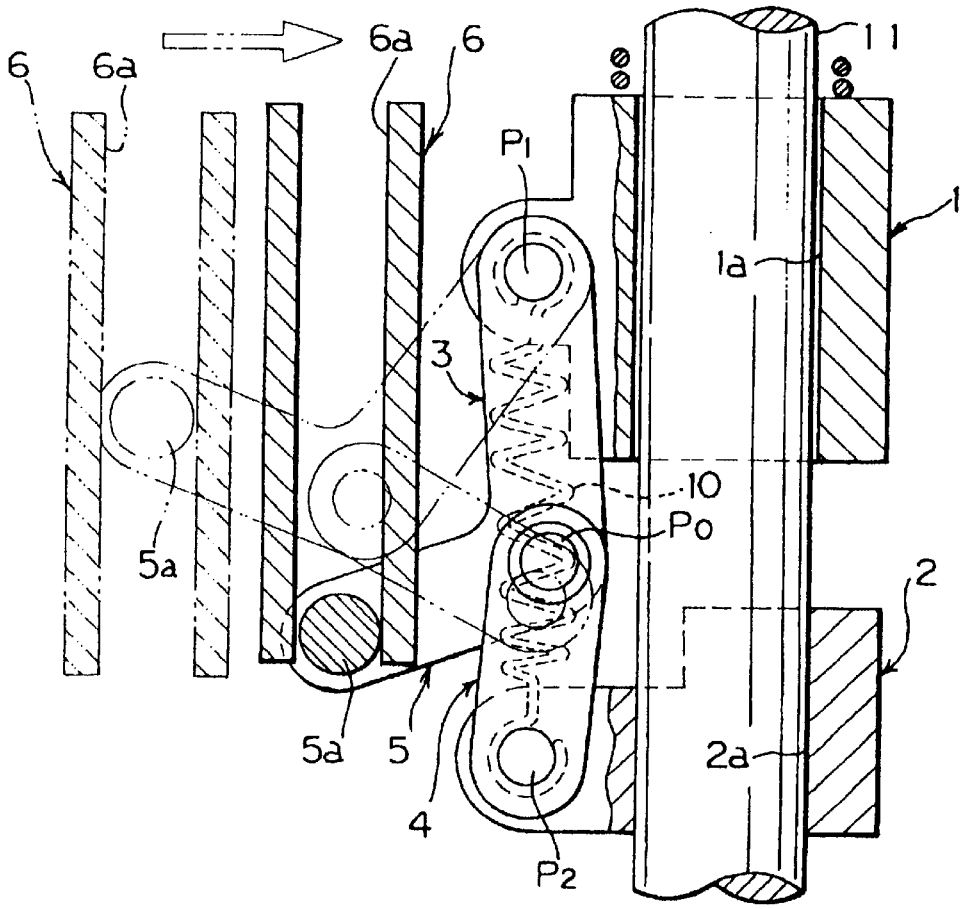
FIG. 6B is a further enlarged side elevational view of the essential part of the work pressing bar positioning device of FIG. 5B shown as partly sectioned.
Figure 7A:
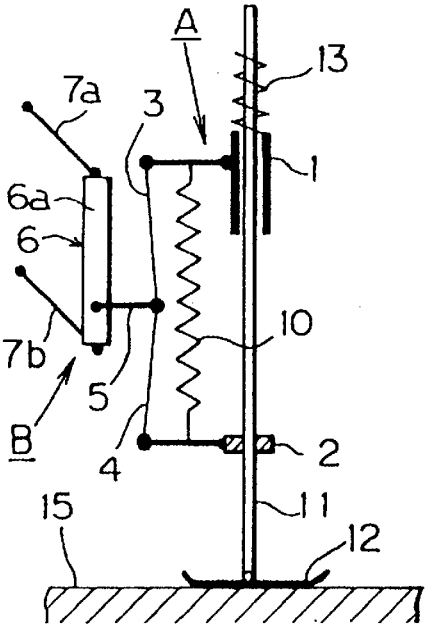
FIG. 7A is a side elevational explanatory view of the work pressing bar positioning device showing the work pressing bar being in the lower operative position.
Figure 7B:
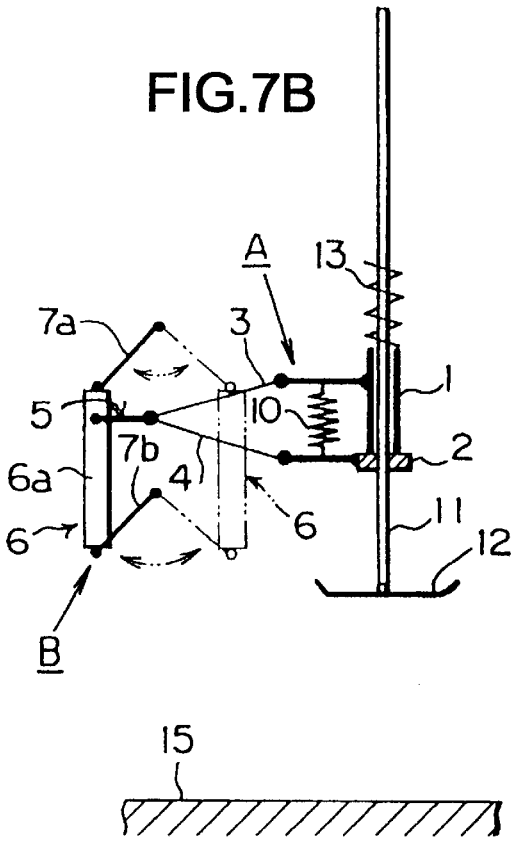
FIG. 7B is a side elevational explanatory view of the work pressing bar positioning device showing the work pressing bar being in the upper inoperative position.
Figure 8A:
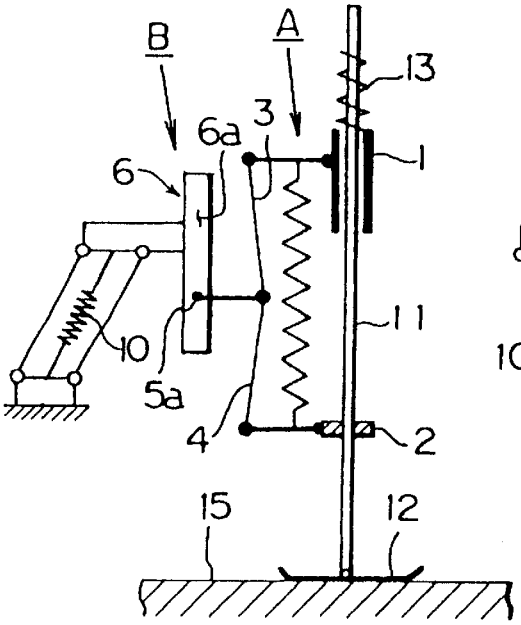
FIG. 8A is a side elevational explanatory view of another embodiment of the work pressing bar positioning device according to the invention.
Figure 8B:
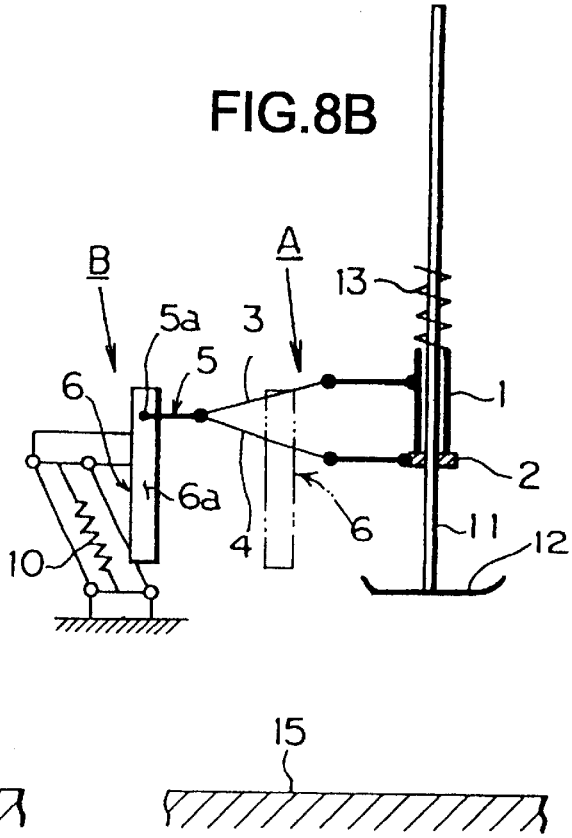
FIG. 8B is a side elevational explanatory view of still another embodiment of the work pressing bar positioning device according to the invention.

On the other hand, when the height changing member 6 is operated to move to the second position as shown in FIG. 5B wherein the height changing member 6 is close to the work pressing bar 11, the lower link 3 is rotated around the pivot point $P_0$ in the direction away from the upper link 4 against the force of the tension spring 10 until the upper and lower links 3, 4 come to be generally in alignment with each other in vertical direction, but slightly inclined to the left beyond the dead point the lower holder 2 is moved down away from the upper holder 1. In the meantime, the pin 5*a* of the lever part 5 of the upper link 3 is vertically moved as guided by the guide 6*a*.

As shown in FIGS. 1, 2A and 2B, a compression spring 13 is provided axially around the work pressing bar 11 and normally gives a pressure to the upper holder 1 in the lower direction. The pressure is, therefore, applied to the work pressing bar 11 and to the work pressing foot 12 accordingly through the upper holder 1 and lower holder 2 which is fixed to the work pressing bar 11 by the fastening screw 2*c* when the height changing member 6 is in the first position laterally far away from the work pressing bar 11 while the work pressing bar 11 is held in the upper inoperative position against the spring force of the compression spring 13 as shown in FIGS. 2A and 2B.

On the other hand, the pressure is applied to the work pressing bar 11 and to the work pressing foot 12 through the holder 1, the upper and lower links 3, 4, the lower holder 2 and the tension spring 10 when the height changing member 6 is in the second position laterally close to the work pressing bar 11 while the work pressing bar 11 is in the lower operative position under the spring force of the compression spring 13 as shown in FIGS. 1 and 5B.

In other words, the work pressing bar 11 is moved to the upper inoperative position by canceling the pressure transmitting route of the upper and lower links 3, 4, that is, by moving the height changing member 6 from the second position as shown in FIGS. 1 and 5B to the first position as shown in FIGS. 2A, 2B and 5A, wherein the upper and lower links 3, 4 are rotated around the pivot point $P_0$ in the direction to come towards each other due to the force of the tension spring 10 while the upper and lower holders 1, 2 are in contact with each other to transmit the spring force of the compression spring 13 to the work pressing bar 11 through another route of the upper and lower holders 1, 2.

Figure 9:
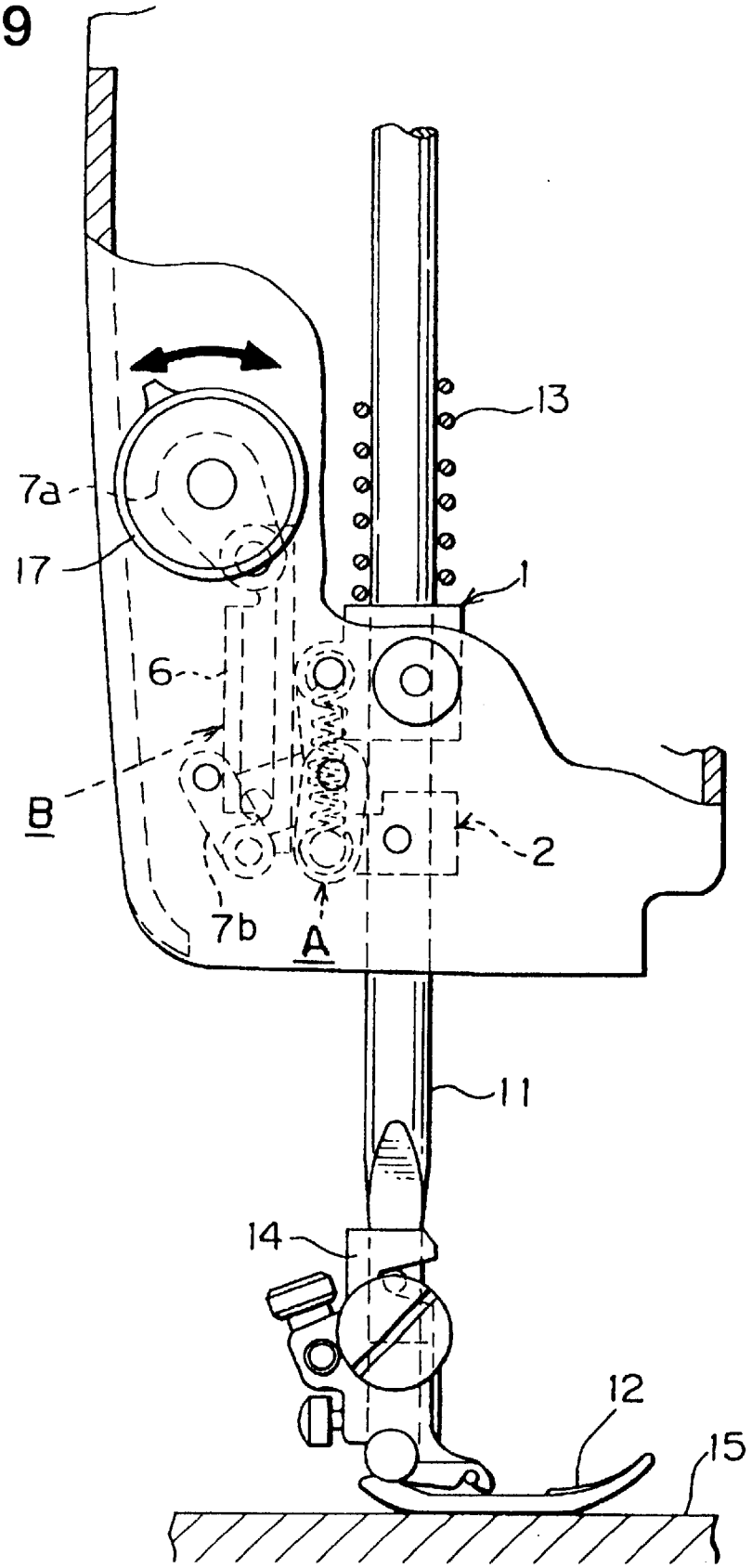
FIG. 9 is a side elevational view of an embodiment of the work pressing bar positioning device according to the invention wherein a manually operated knob is used for operation of the device.

The height changing member 6 may be manually operated to laterally move by manipulation of a knob 17, a lever or the like which is operatively connected to the swingable link 7*a* and is accessible at the outside of the sewing machine as shown in FIG. 9.

Figure 10A:
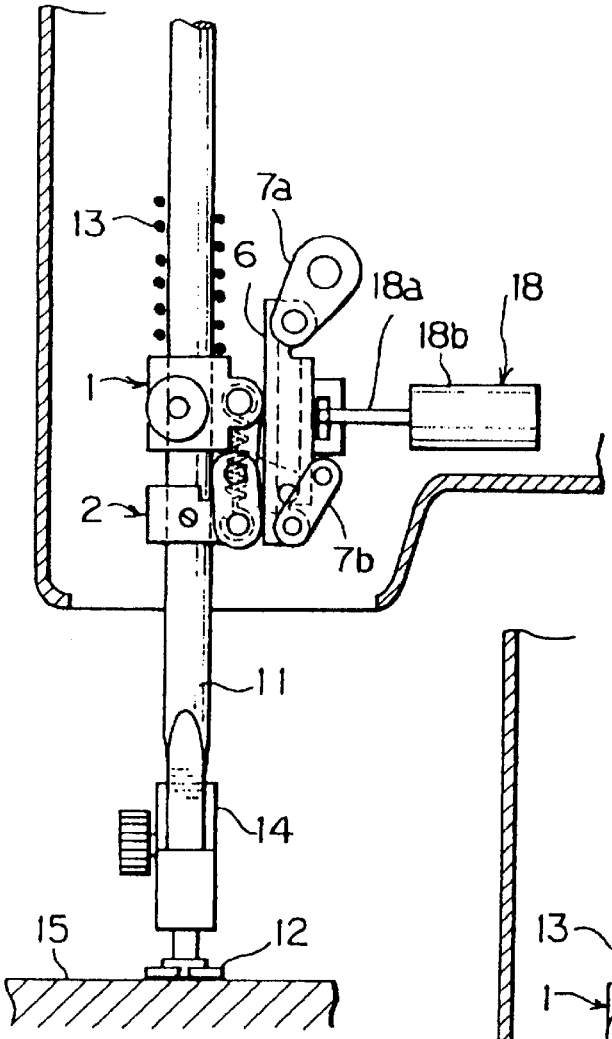
FIG. 10A is a front elevational view of another embodiment of the work pressing bar positioning device according to the invention wherein a solenoid is used for operation of the device, the solenoid being electrically operated to move the work pressing bar to the lower operative position.
Figure 10B:
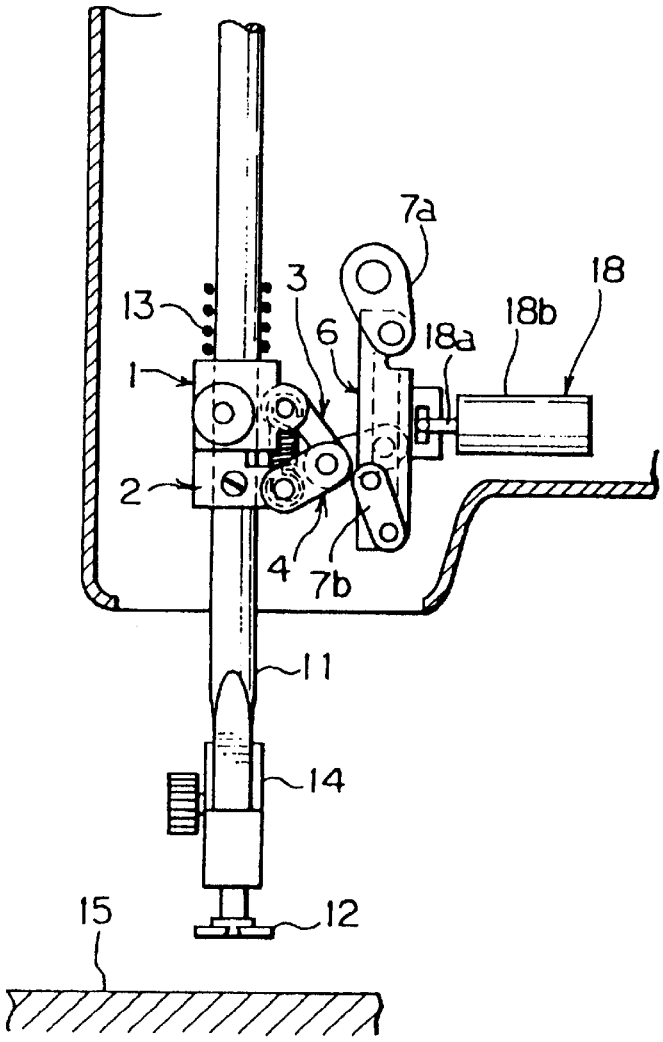
FIG. 10B is a front elevational view of the embodiment of the work pressing bar positioning device of FIG. 10A wherein the solenoid is electrically operated to move the work pressing bar to the upper inoperative position.

The height changing member 6 may be automatically operated to laterally move by operation of a drive source 18 including a solenoid 18*b* having an actuator shaft 18*a* which is operatively connected to the height changing member 6 as shown in FIGS. 10A and 10B. The solenoid 18 may be replaced by a motor.

Figure 13A:
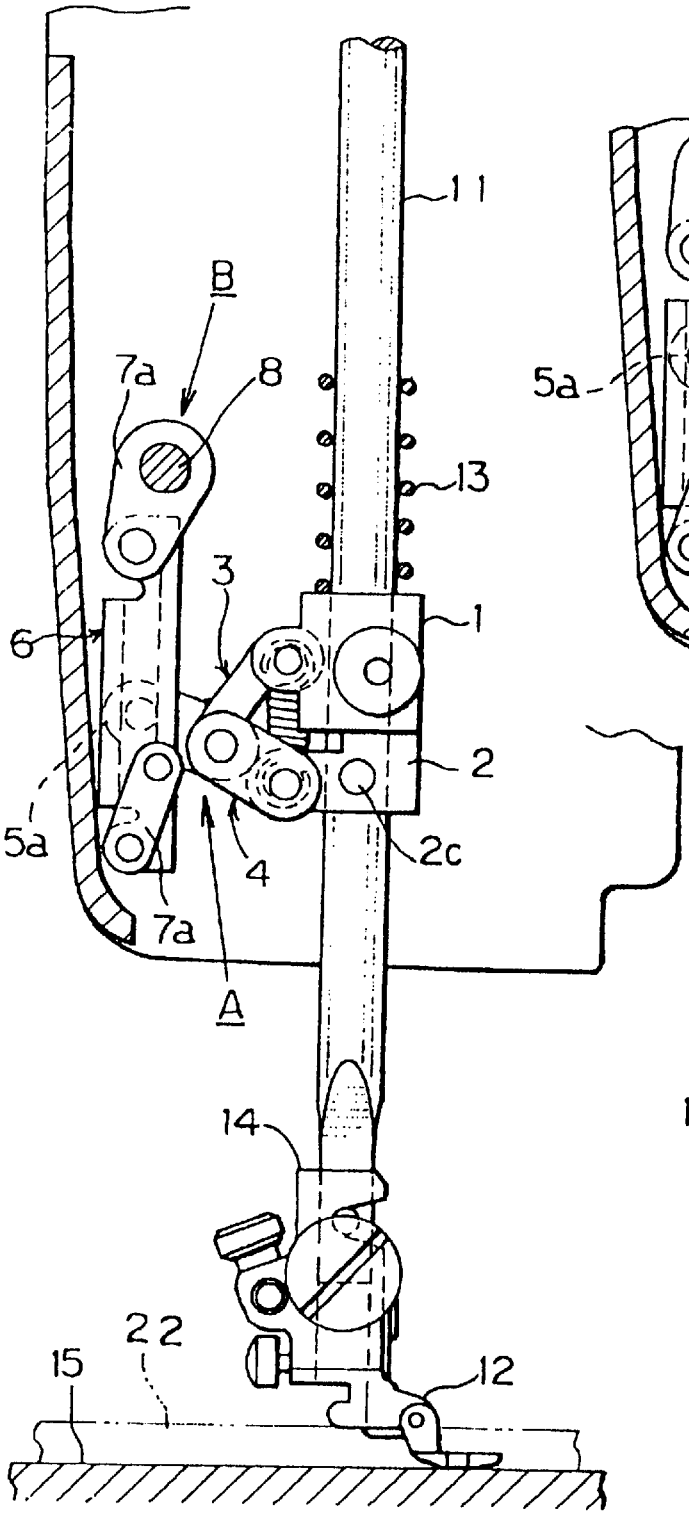
FIG. 13A is a side elevational view of the embodiment of the work pressing bar positioning device according to the invention wherein an embroidery stitching work pressing foot is attached to the lower end of the work pressing bar.
Figure 13B:
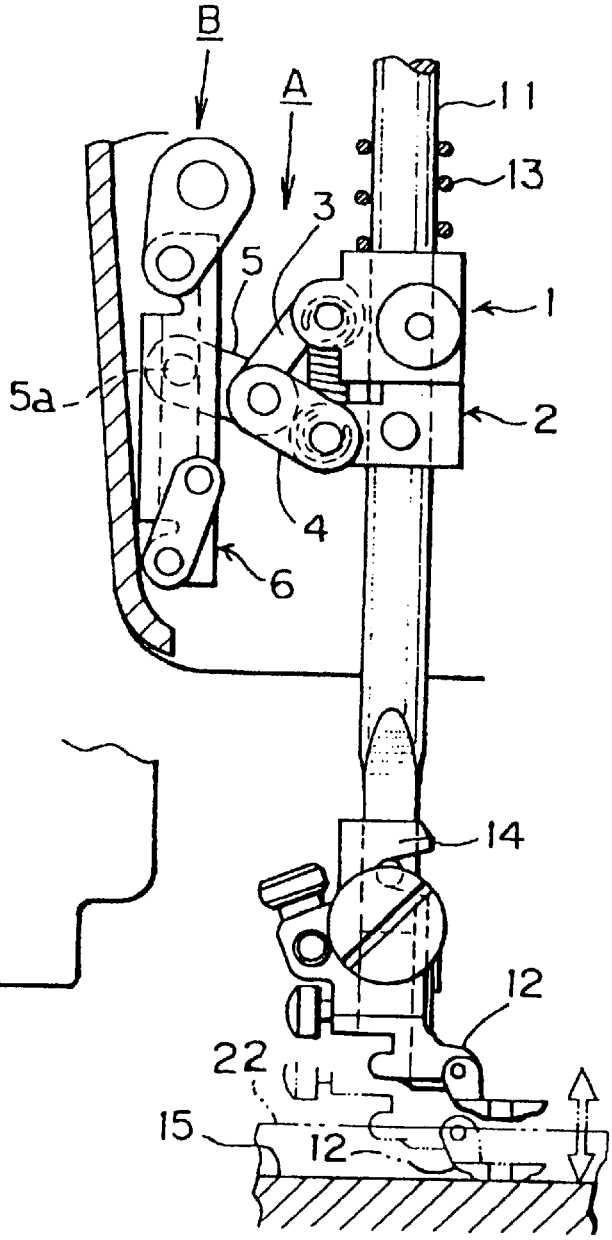
FIG. 13B is a side elevational view of the embodiment of the work pressing bar positioning device of FIG. 13A in case the embroidery stitching operation is performed.
Figure 14A:
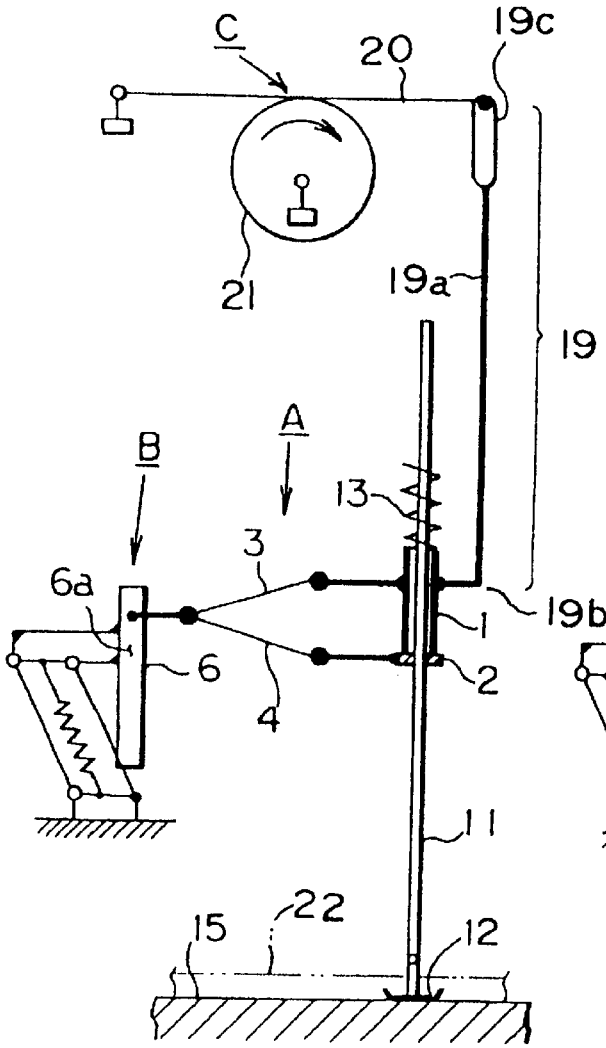
FIGS. 14A and 14B are explanatory front elevational views of the embodiment of the work pressing bar positioning device of FIGS. 13A and 13B respectively showing an embroidery stitching drive mechanism is provided.
Figure 14B:
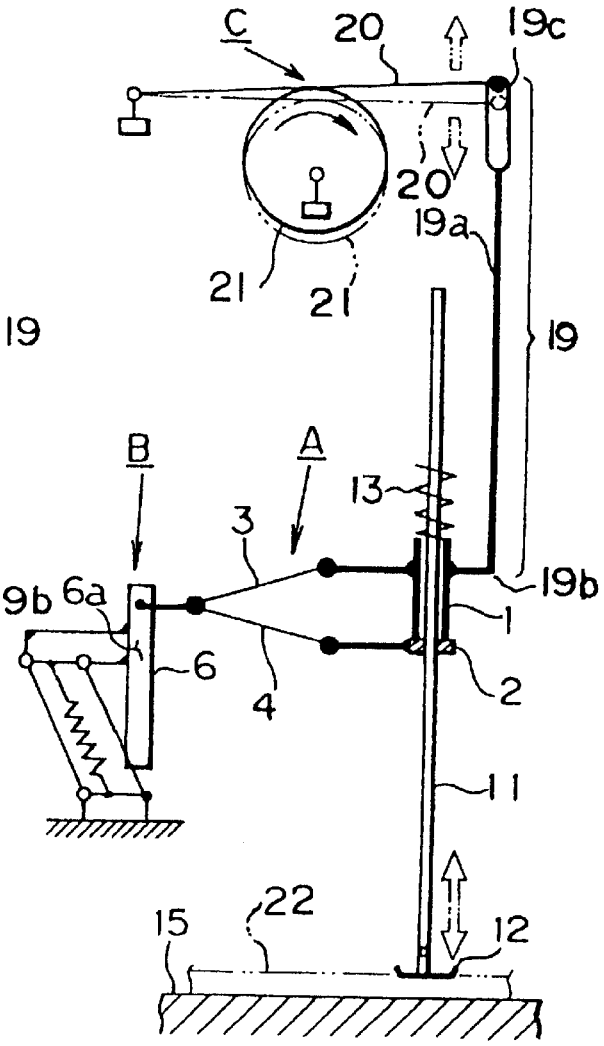

FIGS. 13A and 13B show that a specific work pressing foot 12 for embroidery stitching is removably attached to the lower end of the work pressing bar 11. In this connection, FIGS. 14A and 14B show an embroidery stitching drive mechanism C additionally provided in connection with the invention.

The embroidery stitch drive mechanism C includes a transmission part 19 including a vertical transmission shaft 19*a*, a swingable shaft 20 and a rotary eccentric cam 21. The transmission shaft 19*a* has a lower end 19*b* operatively connected to the upper holder 1 and an upper end 19*c* operatively connected to one end of the swingable shaft 20 which is in engagement with the eccentric cam 21 and is swingingly moved in accordance with rotation of the eccentric cam 21.

It is, therefore, apparent that as the eccentric cam 21 is rotated, the swingable shaft 20 is swingingly moved in vertical direction. The swinging movement of the swingable shaft 20 is transmitted to the upper holder 1 through the transmission shaft 19*a*. The upper holder 1 is, therefore, vertically reciprocated as is regulated by the swinging movement of the swingable shaft 20.

The reciprocating movement of the upper holder 1 is transmitted to the work pressing bar 11 through the link mechanism A of upper and lower links 3, 4 and the lower holder 2 which is secured to the is transmitted to the work pressing bar 11. Thus the work pressing bar 11 is vertically reciprocated while the link mechanism A is vertically reciprocated as the pin 5*a* of the lever part 5 of the upper link 3 is vertically reciprocated as guided by the guide 6*a* of the height changing member 6 as shown in FIGS. 13A and 13B wherein the height changing member 6 is held in the first position and the upper and lower holders 1, 2 are in contact with each other.

It is, therefore, apparent that the embroidery stitching work pressing foot 12 is vertically reciprocated between an upper position where the work pressing foot 12 is spaced from the work held by an embroidering frame 22 located on the needle plate 15 and a lower position where the work pressing foot 12 is in contact with the work held by an embroidering frame 22.

Figure 11A:
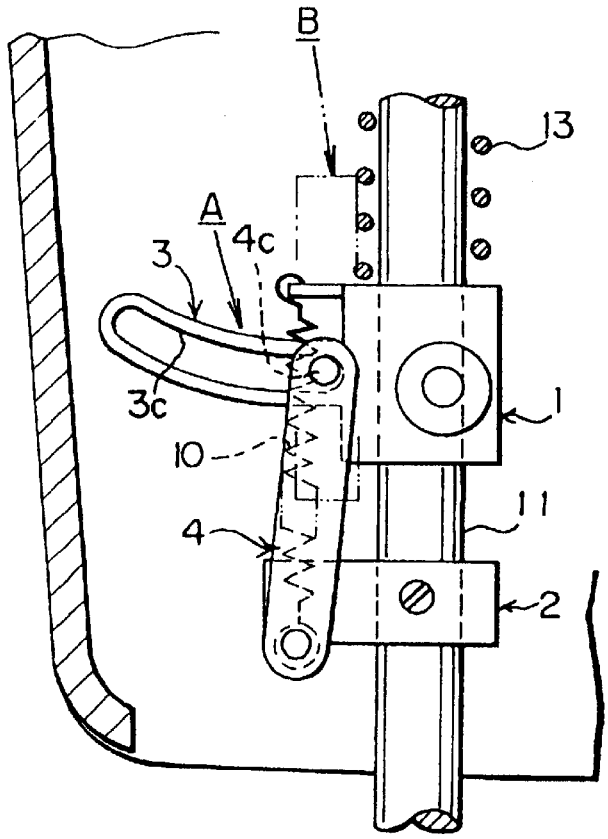
FIG. 11A is a side elevational view of another embodiment of the work pressing bar positioning device according to the invention which is operated to move the upper and lower holders far from each other.
Figure 11B:
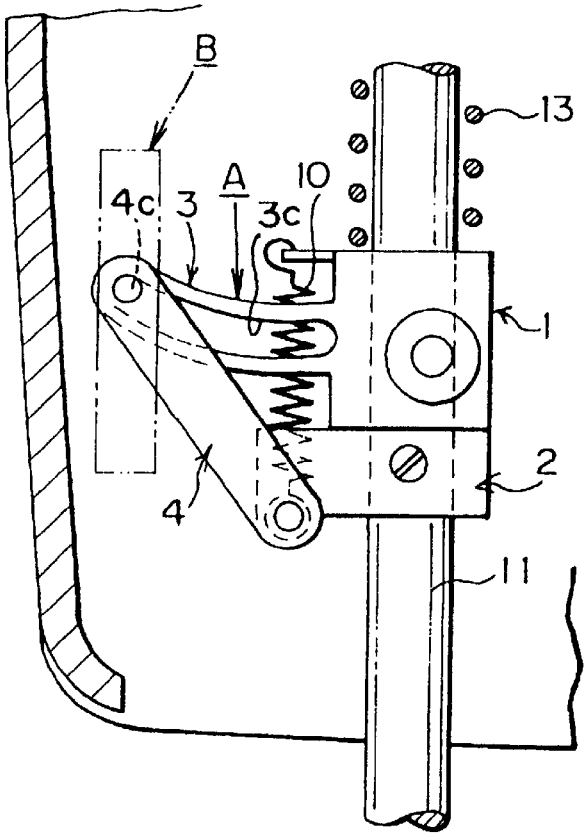
FIG. 11B is a side elevational view of the embodiment of the work pressing bar positioning device of 11A which is operated to move the upper and lower holders close to each other.

FIGS. 11A and 11B show another embodiment of the invention wherein the upper link 3 of the link mechanism A is formed integral with the upper holder 1 and is formed with a laterally extending guide groove 3*c* while the lower link 4 has the lower end operatively connected to the lower holder 2 as is in the same manner with the first embodiment and has the upper end provided with a pin 4*c* which is in engagement with the guide groove 3*c* of the upper link 3 and is further in engagement with the vertical guide 6*a* of the height changing mechanism B.

It is, therefore, apparent that as the height changing mechanism B is laterally moved, the pin 4*c* is laterally moved as guided by the guide groove 3*c* of the upper arm 3, thereby to operate the lower link 4 to move the upper and lower holders 1, 2 between the position where the two holders come to contact with each other and the position where the two holders are spaced from each other, thereby to hold the work pressing bar 11 at the upper inoperative position and the lower operative position.

Figure 12A:
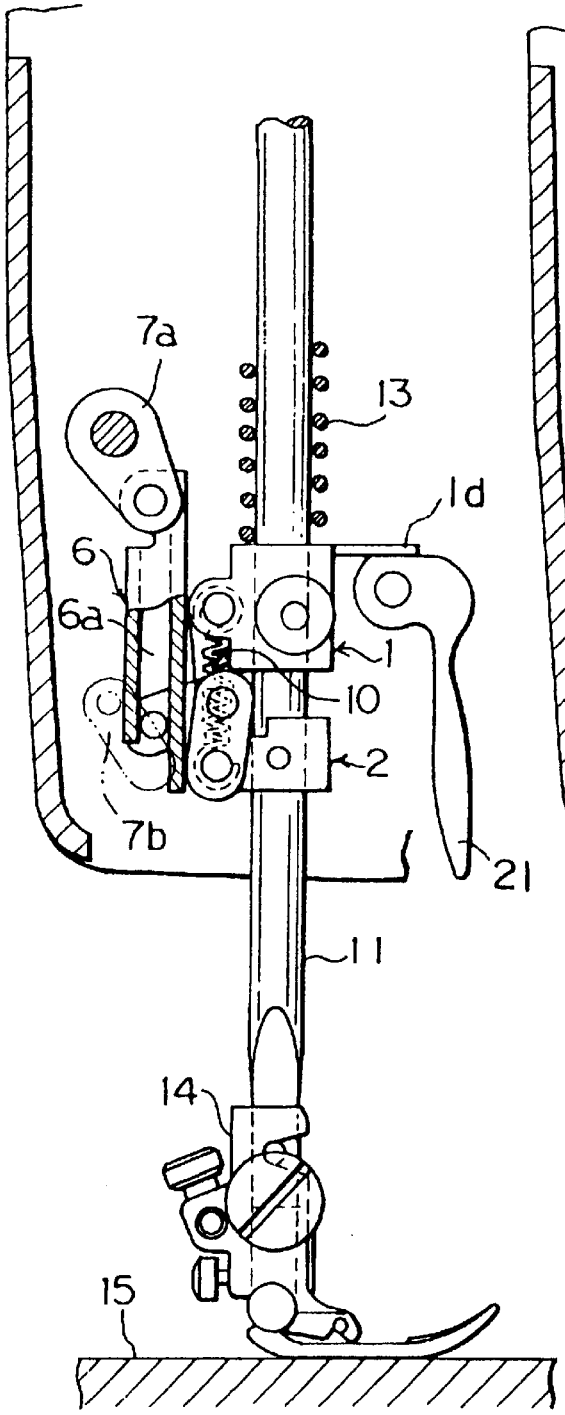
FIG. 12A is a side elevational view of another embodiment of the work pressing bar positioning device according to the invention wherein a lever is used to manually operate the device, the lever being operated to move the work pressing bar to the lower operative position.
Figure 12B:
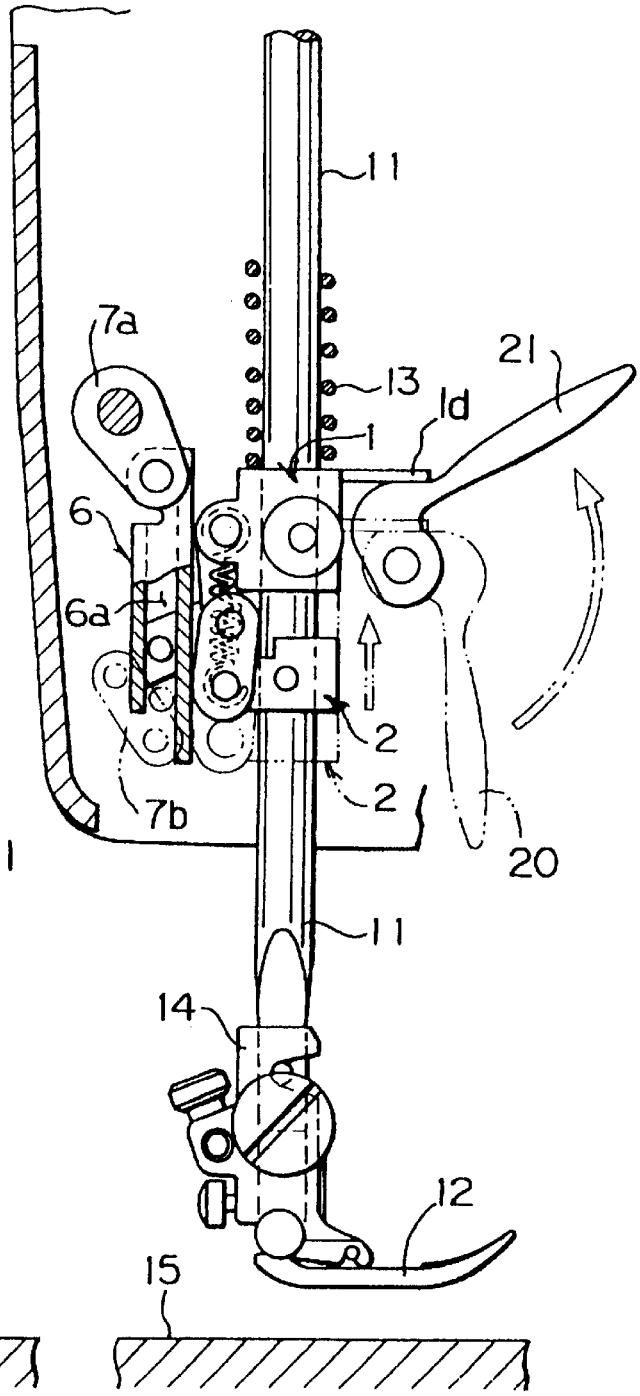
FIG. 12B is a side elevational view of the embodiment of the work pressing bar positioning device of FIG. 12A wherein the lever is operated to move the work pressing bar to the upper inoperative position.

FIGS. 12A and 12B show another embodiment of the invention, wherein a lever 21 provided in connection with the upper holder 1. The lever 21 is arranged in contact with an engaging part 1*d* of the upper holder 1 and is manually operated to move the upper holder 1 between the upper position, wherein the work pressing bar 11 is moved from the lower operative position to the upper inoperative position against the spring force of the compression spring 13 through the upper holder 1, the transmission link mechanism A and the lower holder 2 and a lower position, wherein the work pressing bar 11 is moved from the upper inoperative position to the lower operative position by the spring force of the compression spring 13 through the upper holder 1, the transmission link mechanism A and the lower holder 2. In the meantime, the transmission link mechanism A is vertically moved accordingly as guided by the guide 6*a* of the height changing member 6. In the meantime, the height changing member 6 is held in the second position wherein the upper and lower holders 1, 2 are positioned as spaced from each other.

The invention being thus described, it may be obvious that the same may be varied in many ways. Such variations are not to be regarded as a departure from the spirit and scope of the invention, and all such modifications are intended to be included within the scope of the following claims.

What is claimed is:

1. A sewing machine with a work pressing bar positioning device having a work pressing bar having a work pressing foot removably attached to a lower end thereof and being vertically movable between a first set position in which the work pressing foot is in contact with a needle plate in a lower position and a second set position in which the work pressing foot is vertically spaced up from the needle plate, said sewing machine comprising:

(a) means for giving a pressure to said work pressing bar, thereby to press said work pressing foot against said needle plate;

(b) means for transmitting said pressure given by said pressure giving means to said work pressing bar when said work pressing bar is in the first set position;

(c) means operated to cancel the transmission of said pressure to said work pressing bar;

(d) means operated in response to operation of said transmission canceling means to move said work pressing bar from said first set position to said second set position;

(e) means for operating said transmission canceling means to change over a set position of said work pressing bar between said first set position and said second set position;

wherein said means for transmitting said pressure to said work pressing bar includes:

(1) a means mounted on said work pressing bar and being movable axially of said work pressing bar, said mounting means being normally subjected to said pressure giving means, (2) a means fixedly connected to said work pressing bar at a lower position with respect to said axially movable means, (3) a first link having one end operatively connected to said axially movable means, (4) a second link having one end operatively connected to the opposite end of said first link and has the opposite end operatively connected to said means which is fixedly connected to said work pressing bar, and (5) a means provided between said axially movable means and said fixedly connected means and normally exerting a force to move said fixedly connected means towards said axially movable means.

2. The sewing machine as defined in claim 1, wherein said means for canceling the transmission of said pressure to said work pressing bar includes means for operating said first and second links between a first position in which said first and second links are vertically in alignment with each other as extended beyond a dead point against the force of said force exerting means and a second position in which said second link is moved towards said first link by the force of said force exerting means.

3. A sewing machine with a work pressing bar positioning device having a work pressing bar having a work pressing foot removably attached to a lower end thereof and being vertically movable between a first set position in which the work pressing foot is in contact with a needle plate in a lower position and a second set position in which the work pressing foot is vertically spaced up from the needle plate, said sewing machine comprising:

(a) an upper holder mounted on said work pressing bar and being movable axially of said work pressing bar.

(b) a spring giving a force for normally pressing down said upper holder axially of said work pressing bar.

(c) a lower holder fixedly connected to said work pressing bar, (d) transmission means for operatively connecting said upper holder and said lower holder, (e) means for positioning said work pressing bar between said first set position and said second set position, said positioning means being operated in one way to operate said transmission means to operatively connect said upper and lower holders, thereby to move said work pressing bar to said first set position from said second set position, said positioning means being operated in another way to operate said transmission means to operatively disconnect said upper and lower holders.

* * * * *